US007291260B2

(12) United States Patent
Mullner, Jr.

(10) Patent No.: US 7,291,260 B2
(45) Date of Patent: Nov. 6, 2007

(54) SKIMMER GUARD FOR A SWIMMING POOL

(76) Inventor: Nandor Mullner, Jr., 212 Edgar Ave., Aston, PA (US) 19014

( * ) Notice: Subject to any disclaimer, the term of this patent is extended or adjusted under 35 U.S.C. 154(b) by 149 days.

(21) Appl. No.: 11/289,253

(22) Filed: Nov. 29, 2005

(65) Prior Publication Data

US 2007/0119760 A1 May 31, 2007

(51) Int. Cl.
*E04H 4/12* (2006.01)

(52) U.S. Cl. ..... 210/167.1; 210/167.19; 210/232; 210/416.2; 4/507

(58) Field of Classification Search ..... 210/167.1, 210/167.19, 232, 416.1, 416.2, 459; 4/507
See application file for complete search history.

(56) References Cited

U.S. PATENT DOCUMENTS 1,654,246 A 12/1927 Egan
3,733,621 A * 5/1973 Jannuzzi, Jr. ..... 4/506
4,140,634 A 2/1979 Harry
4,594,157 A 6/1986 McGowan
4,903,351 A * 2/1990 Dengel et al. ..... 4/496
5,195,191 A * 3/1993 Stefan et al. ..... 4/508
5,285,538 A 2/1994 Hodak
5,833,845 A 11/1998 Anderson
5,935,450 A 8/1999 Benedict
D429,858 S 8/2000 Smith
6,214,217 B1 4/2001 Sliger
D444,628 S 7/2001 Schwarz
6,817,041 B1 * 11/2004 Evans et al. ..... 4/496
6,989,094 B2 * 1/2006 Knapp et al. ..... 210/167.19
2005/0199538 A1 * 9/2005 Knapp et al. ..... 210/169

* cited by examiner

*Primary Examiner*—Fred G. Prince
(74) *Attorney, Agent, or Firm*—William H. Eilberg

(57) ABSTRACT

A skimmer for a pool includes a skimmer guard that is installed by friction only, and without the use of separate fasteners. The skimmer guard includes a perforated plate which acts as a strainer, preventing debris from the pool from entering the skimmer. The skimmer guard is inserted into gap between heads of a double-headed screw which is permanently screwed into the pool wall. The skimmer guard can be removed, and re-installed, simply by sliding the skimmer guard out of, or into, the gap. The skimmer guard can therefore be removed and re-installed without the use of separate fasteners, and without the use of tools. The skimmer guard can be removed and replaced with a non-perforated cover, at the end of the swimming season.

15 Claims, 4 Drawing Sheets

SKIMMER GUARD FOR A SWIMMING POOL

BACKGROUND OF THE INVENTION

The present invention relates to the field of treatment of water for swimming pools and the like, and provides a convenient device for preventing debris from interfering with such treatment.

A swimming pool is commonly equipped with a skimmer, which is a device for drawing in water from the pool, filtering the water, and returning the filtered water to the pool. Skimmers can be provided both for in-ground pools and above-ground pools, and are usually located immediately outside the periphery of the pool. The skimmer receives water from an opening in the side wall of the pool.

A major problem in the operation of a skimmer is the unwanted entry of debris from the pool. At any given time, there may be various items floating in the pool, such as leaves, children's toys, or other objects. These items inevitably float towards the skimmer opening, especially in view of the negative pressure created by the flow of water into the skimmer. Thus, the debris will likely enter the skimmer, potentially causing serious clogs, and preventing the skimmer from operating properly. A severe clog may cause the circulation pump of the skimmer to burn out.

A skimmer typically has a flap, disposed in an opening of the pool wall, for regulating the flow of water into the skimmer. Entry of debris into the opening may interfere with the operation of the flap. The skimmer may also include a device for automatically dispensing chlorine into the pool. Debris from the pool may interfere with the dispensing of chlorine.

Another problem with typical skimmers is caused by children. A curious child can easily insert his or her hand into the skimmer opening, interfering with the above-described flap and/or chlorine dispenser. It is therefore necessary to provide a device which prevents such occurrences.

Various efforts have been made to solve the above problems. The typical solution is to cover the skimmer opening with a screen or strainer, as is shown, for example, in U.S. Pat. Nos. 4,140,634 and 6,214,217. While such devices, and others, do prevent much debris from entering the skimmer, and do prevent access to components within the skimmer opening, the devices are inconvenient to use, as they are attached to the skimmer opening by separate fastening devices, such as screws or nails. Thus, for both installation and removal of such devices, the user must have a tool available, such as a screwdriver.

U.S. Pat. No. 5,285,538 discloses a cover that does not need to be screwed in, but the patented cover serves to seal off the skimmer during the season in which the pool is not in use. The latter patent does not show a device which will protect a skimmer from debris when the pool is in use.

Copending U.S. patent application Ser. No. 11/180,355, filed Jul. 13, 2005, the disclosure of which is incorporated by reference herein, shows a skimmer guard which can be inserted and removed without the use of tools or fasteners. The above-described device includes a perforated portion having a peripheral lip which frictionally engages a flange formed on a frame for the skimmer opening. This device is workable as long as such a flange exists. But for pools in which the skimmer opening is not provided with such a flange, a different solution is necessary.

The present invention provides a skimmer guard which can be used where the skimmer opening has no flange, thus overcoming the limitation of the device shown in Ser. No. 11/180,355. The invention provides a skimmer guard which, once installed, can be removed and re-installed without the use of any tool.

SUMMARY OF THE INVENTION

The present invention comprises a skimmer guard which covers an opening in a pool wall, and wherein the skimmer guard is installed by friction only, and without separate fasteners. The skimmer guard defines a plurality of holes which allow liquid to flow into the skimmer, while preventing the entry of debris.

The skimmer opening is bounded by a frame, the frame being attached to the pool wall by a plurality of double-headed screws. Each double-headed screw has an inner head and an outer head which are spaced apart to form a gap. The screw is inserted such that the gap is forward of the frame. The skimmer guard includes a plurality of keyholes, each having a larger diameter portion and a smaller diameter portion. The skimmer guard is installed by placing the larger diameter portions over the outer heads of the double-headed screws, so that the outer heads pass through the larger diameter portions, and then by pushing the skimmer guard downward, so that some of the material of the skimmer guard becomes wedged in the gap between the heads. The skimmer guard is removed by reversing the above steps. The removal and re-installation is performed without the use of any tool, as the double-headed screws are intended to remain permanently in place.

A non-perforated skimmer cover, also having keyholes similar to those of the perforated skimmer guard, can be installed and removed in the same way. The non-perforated cover is useful during seasons when the pool is not in use, and it is desired to block all access to the skimmer opening.

The invention also includes the method of protecting a pool skimmer, the method comprising engaging a skimmer guard with an opening in the pool wall, the engagement being performed by friction only and without separate fasteners. The engagement of the skimmer guard can be accomplished by pushing the skimmer guard over a plurality of screw heads, such that the heads pass through the skimmer guard, and then pushing the skimmer guard downward until the material of the skimmer guard becomes wedged in the gap between the inner and outer heads of the screw.

The invention also includes the method wherein a perforated skimmer guard is installed, and wherein the perforated skimmer guard is removed and replaced with a similar skimmer cover which is constructed without holes. Typically, the perforated skimmer guard is installed at the beginning of the swimming season, and the non-perforated skimmer guard is installed at the end of such season.

The invention therefore has the primary object of providing a skimmer guard for a swimming pool.

The invention has the further object of providing a skimmer guard which can be attached without the use of separate fasteners such as screws, nails, or the like.

The invention has the further object of providing a skimmer guard which can be installed without the use of tools.

The invention has the further object of prolonging the useful life of a pool skimmer, by preventing entry of debris from the pool.

The invention has the further object of providing a method of attachment and removal of a skimmer guard.

The invention has the further object of providing a convenient method of changing skimmer guards at the beginning and end of a season of swimming pool use.

The invention has the further object of providing a convenient and economical means for preventing debris from entering, and potentially clogging, a pool skimmer.

The invention has the further object of preventing harm to components located within a skimmer guard due to contact by children.

The reader skilled in the art will recognize other objects and advantages of the present invention, from a reading of the following brief description of the drawings, the detailed description of the invention, and the appended claims.

DETAILED DESCRIPTION OF THE INVENTION

The present invention includes a skimmer guard, comprising a perforated plate installed over a skimmer opening. Once it has been installed, the skimmer guard can be repeatedly removed and re-installed without the use of any tools.

Figure 1:
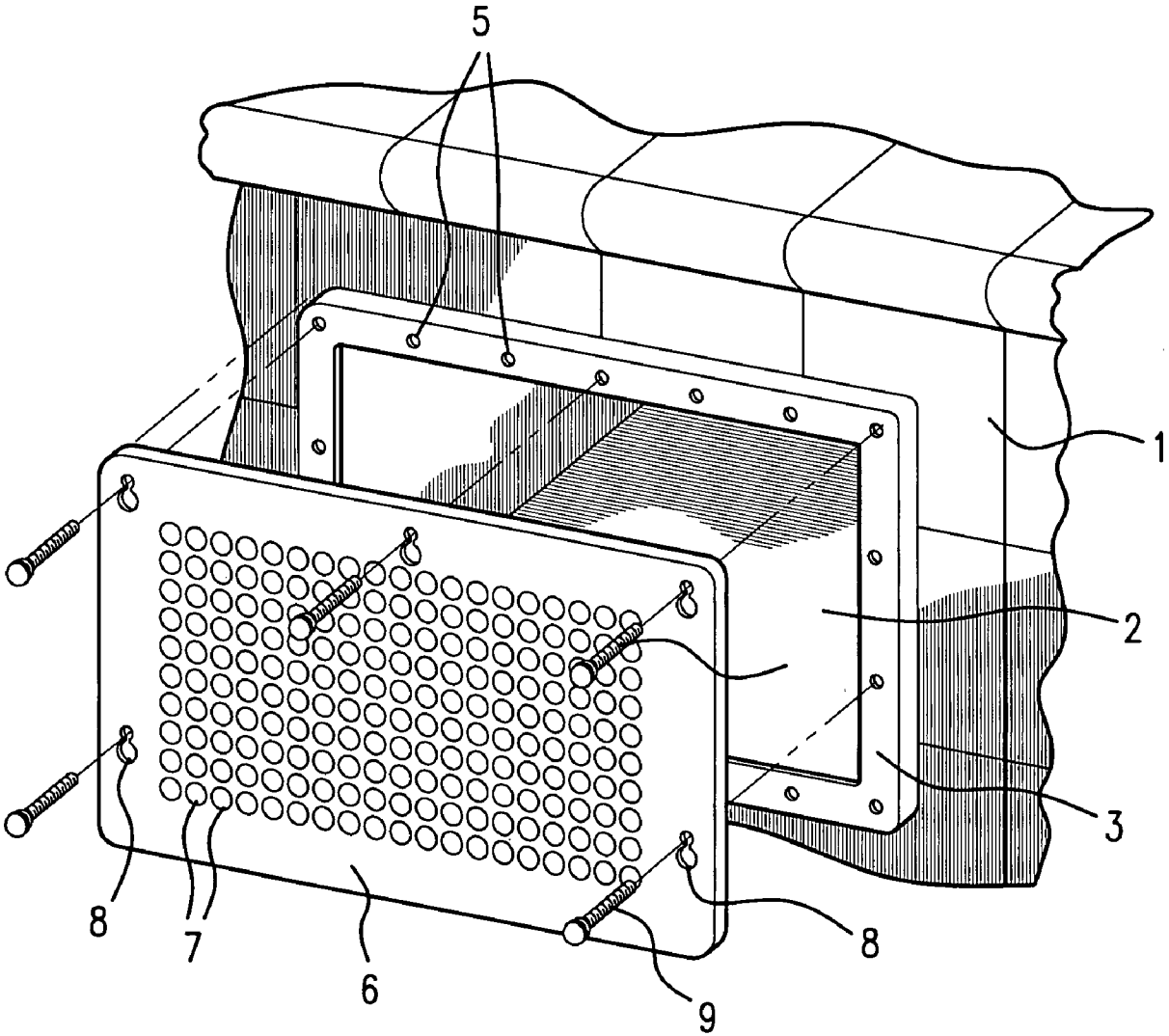
FIG. 1 provides a fragmentary, exploded perspective view, showing a skimmer opening of a swimming pool, the opening being equipped with a skimmer guard made according to the present invention.
Figure 2:
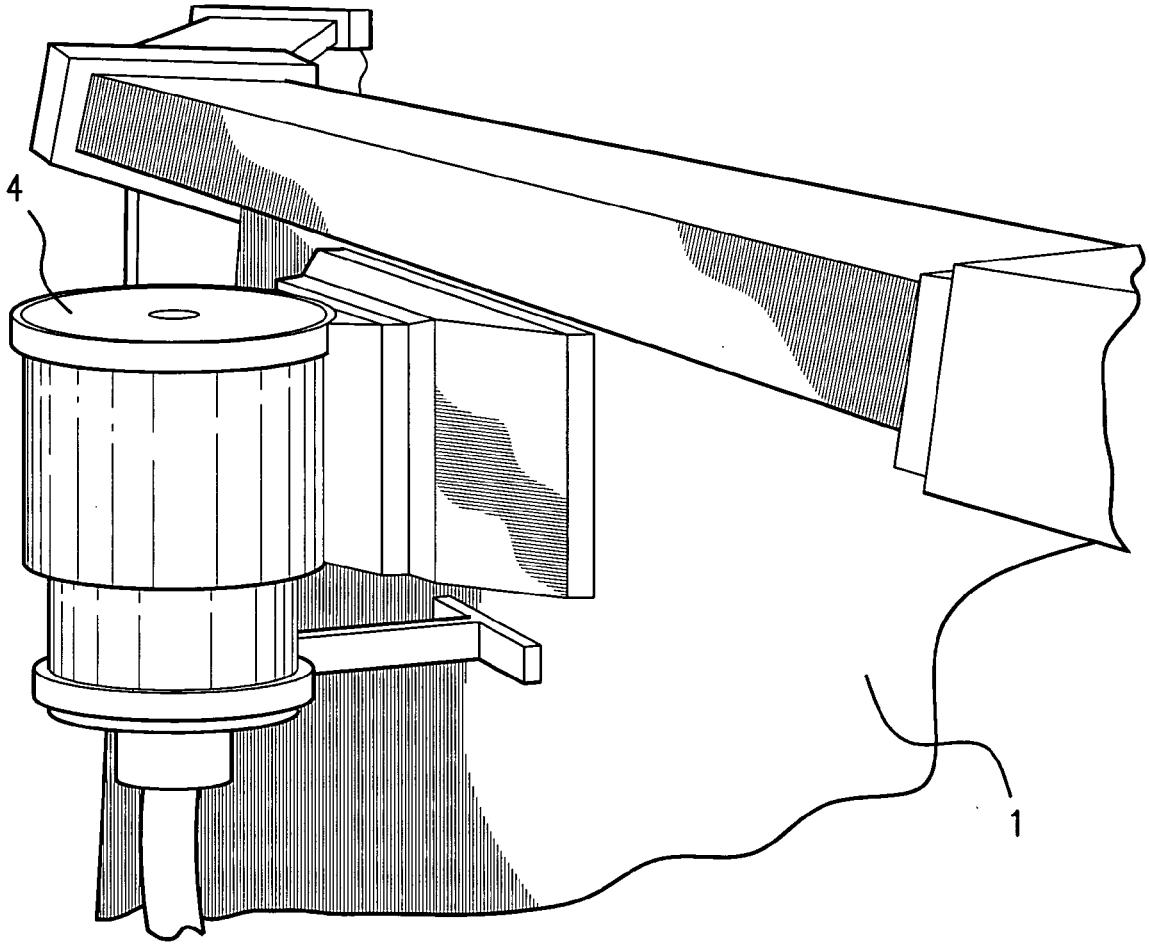
FIG. 2 provides a fragmentary perspective view of an exterior portion of a swimming pool, showing the skimmer used with the present invention.

FIG. 1 shows pool wall 1 defining a skimmer opening 2. The skimmer opening provides access to skimmer 4 (see FIG. 2). That is, the skimmer opening allows water from the pool to enter the skimmer, which is located outside the periphery of the pool wall. In the illustration of FIG. 2, the pool is an above-ground structure, and the skimmer is plainly visible. The invention could also be practiced with an in-ground pool, in which case the skimmer may be located below ground level.

The skimmer opening 2 is bounded by frame 3, which is affixed to the wall, such as by screws 5, the frame being intended to comprise a permanent fixture of the pool.

A skimmer guard 6 comprises a plate having a plurality of perforations 7. The perforations are intended to remain unblocked while the skimmer guard is in use. Thus, the perforated plate essentially comprises a strainer, allowing water from the pool to flow into the skimmer, but preventing debris having a size greater than that of the perforations from entering the skimmer. The size of the debris capable of entering the skimmer is determined by the size of the holes in the skimmer guard.

The skimmer guard also inherently protects components that may be located within the skimmer opening. Such components may include a flap which regulates the flow of liquid into the skimmer, and may also include a device for dispensing chlorine into the pool. The skimmer guard prevents debris from interfering with these components, and also prevents children from reaching into the opening and damaging such components. It also prevents harm to children that may result from such contact.

The skimmer guard includes a plurality of keyholes 8, each keyhole including a smaller diameter portion and a larger diameter portion, the two portions being connected. The locations of the keyholes correspond with locations of some of the screws 5. In the embodiment shown in FIG. 1, there are five keyholes, but the number could be varied within the scope of the invention.

The skimmer guard is attached to the frame 3 and the pool wall 1 by a plurality of double-headed screws 9. The structure of the double-headed screws is shown in more detail in FIGS. 3-5. The double-headed screws define a gap 16 between the two heads (see FIG. 5), into which a portion of the skimmer guard can fit. The skimmer guard can be removed from the gap, and re-installed, without disturbing the screw. The double-headed screws are intended to replace those screws 5 which are located at positions corresponding to the keyholes 8.

In practice, many swimming pools are provided with skimmer frames such as frame 3, with screws such as screws 5. In implementing the present invention, it is intended that those screws 5 positioned at locations corresponding to the double-headed screws 9 will be discarded after being effectively replaced by the double-headed screws.

Figure 4:
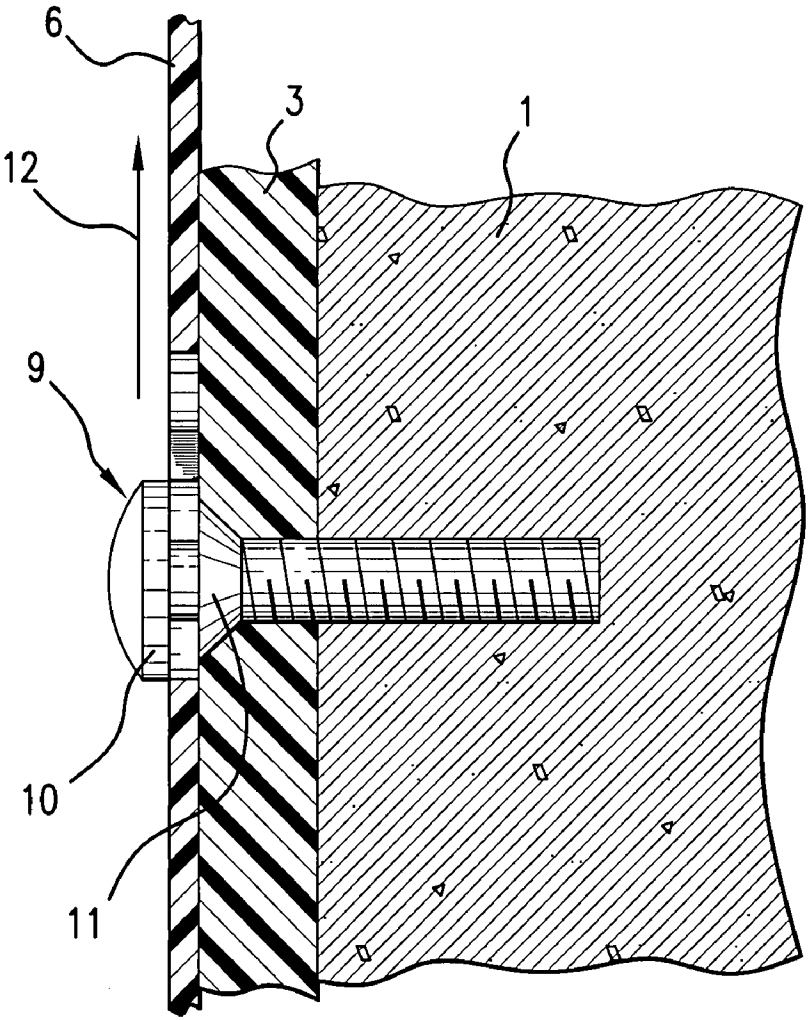
FIG. 4 provides a fragmentary cross-sectional view similar to FIG. 3, but in which the skimmer guard has been lifted relative to the double-headed screw, for removal of the skimmer guard.
Figure 3:
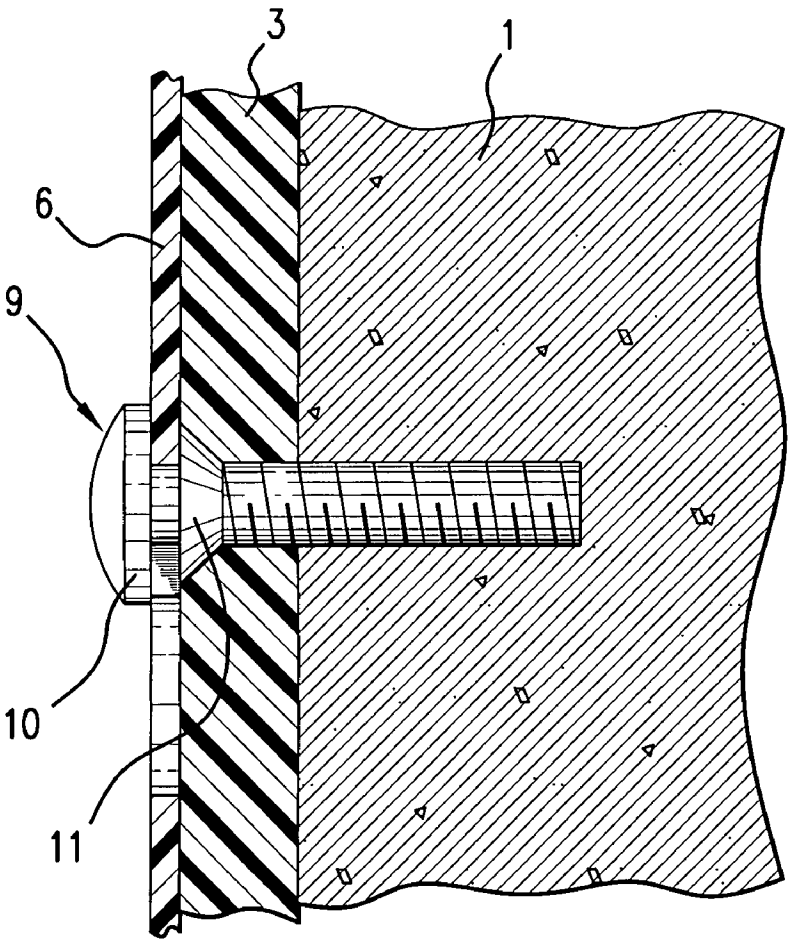
FIG. 3 provides a fragmentary cross-sectional view of a portion of the skimmer guard of the present invention, wherein the skimmer guard engages a double-headed screw which is affixed to the pool wall.

FIGS. 3 and 4 show a double-headed screw 9 inserted into the frame 3 and the pool wall 1. Each screw has an outer head 10 and a conical inner head 11. The screw is screwed into the pool wall to a depth such that the inner head becomes fully embedded in the frame 3, i.e. so that the inner head is flush with the outer surface of the frame. Thus, the outer head 10 and the inner head 11 together define a gap 16 (most clearly illustrated in FIG. 5) which is positioned immediately forward of the frame. Thus, a portion of the skimmer guard can be installed within this gap, and a portion of the skimmer guard remains in abutment with the frame, as shown in FIG. 3.

In FIG. 3, the skimmer guard 6 is inserted between outer head 10 and inner head 11 of the screw 9. The skimmer guard fits snugly between these two heads. The heads engage the skimmer guard at a location near and above the smaller diameter portion of the keyhole.

To remove the skimmer guard, one slides the skimmer guard upward, as indicated by arrow 12 in FIG. 4, so as to place the larger diameter portion of the keyhole in registration with the outer head 10 of screw 9. The skimmer guard can then be removed, without resistance, simply by pulling it over and away from the double-headed screw. The double-headed screw remains permanently in place. The skimmer guard can later be re-installed by sliding it back into the gap between the heads of the double-headed screw. The skimmer guard can be repeatedly removed and re-installed without moving the double-headed screw.

Thus, once the double-headed screw has been screwed into the pool wall, it need not be removed for the life of the pool. A screw driver, or other tool, is not required either to install or remove the skimmer guard. Each removal and re-installation of the skimmer guard involves pushing or pulling the skimmer guard such that the outer heads of the double-headed screws pass freely through the larger diameter openings of the keyholes.

Figure 6:
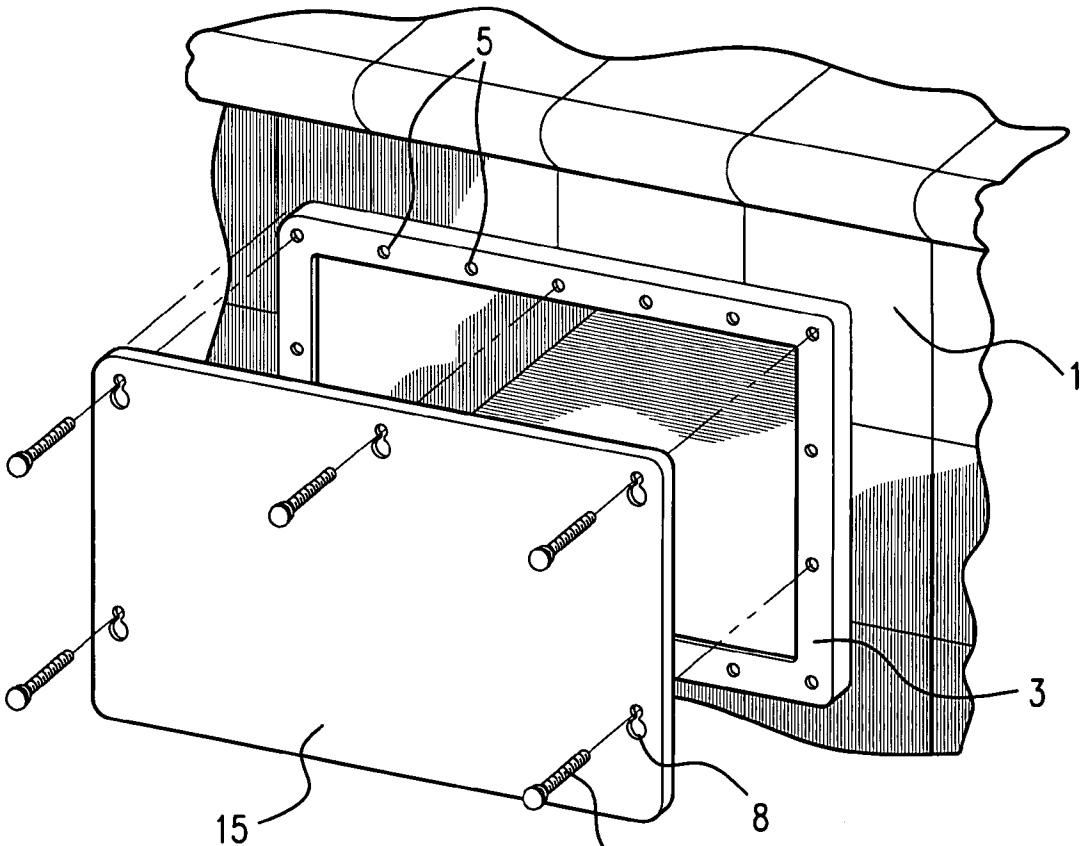
FIG. 6 provides a view, similar to that of FIG. 1, showing a non-perforated skimmer cover which is being affixed to a skimmer opening, according to the present invention.

As described in application Ser. No. 11/180,355, it is possible to provide a non-perforated skimmer guard or cover, similar to skimmer guard 6 but without perforations 7, for the purpose of protecting the skimmer during periods when the swimming pool is not in use. The pool may still be filled, or partly filled, during such periods, and the skimmer would not be operating during this time. It is therefore desirable to prevent water from entering the skimmer during this period. FIG. 6 shows such an arrangement. The non-perforated skimmer cover is designated by reference numeral 15, the other components being the same as in the embodiment of FIG. 1. The non-perforated cover still has the plurality of keyholes 8, similar to the other embodiment. Thus, both the perforated skimmer guard and the non-perforated skimmer cover can be installed and removed in the same way, i.e. by sliding the cover into the gap between the heads of the double-headed screw.

Figure 5:
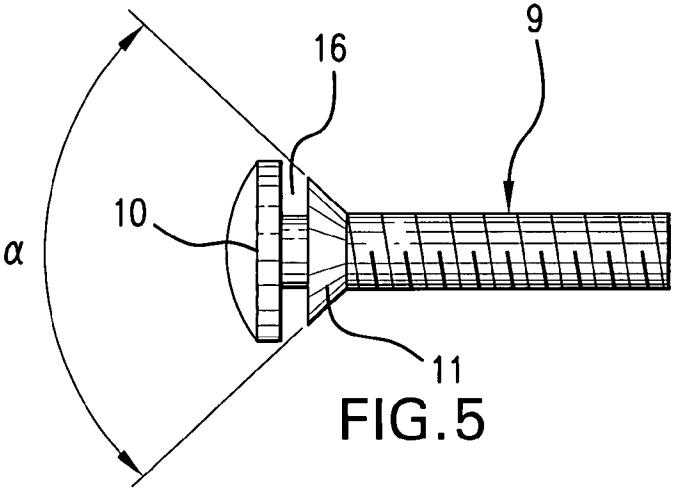
FIG. 5 provides an elevational view of the double-headed screw used in the present invention.

FIG. 5 shows the structure of the double-headed screw 9 in more detail. The conical inner head 11 has surfaces which form an angle $\propto$, which, in one preferred embodiment, is about 82°. The invention is not limited by this particular angle, however. The conical structure allows the inner head to become securely embedded in the material of the frame, as shown in FIGS. 3 and 4.

The present invention also includes the method of replacing a non-perforated skimmer guard with a perforated skimmer guard, as would be typically done at the beginning of the swimming season, and replacing a perforated skimmer guard with a non-perforated skimmer guard, as would be done at the end of the swimming season. The above operations could also be performed at other times, if desired. Provided that the double-headed screws have been previously and permanently installed, all of the above operations are performed without the further insertion of screws, nails, or other fastening devices, and are preferably performed without any tools. By eliminating the need to use fastening devices or tools, the present invention makes it very easy to change the skimmer guard as desired.

The invention also includes the method of installing the perforated skimmer guard over the pool wall opening. The skimmer guard is simply pushed towards the opening, such that the outer heads of the double-headed screws pass through the larger diameter portions of the keyholes, and then pushed downward so that the material above the smaller diameter portion of the keyholes becomes wedged in the gaps between the heads of the double-headed screws. At this point, engagement by friction between the skimmer guard and the screws is complete.

The skimmer guard of the present invention is preferably made of plastic. However, the invention is not limited to any specific material, and could be practiced with skimmer guards made of wood, metal, or other materials.

The invention can be modified in various ways. The specific shape of the skimmer opening could be changed, and such change would require a corresponding change in the shape of the skimmer guard. For example, the opening could be square, or even circular, in which case the skimmer guard would need to be formed with a similar shape for engagement with the skimmer frame. The number of screws 5 affixing the frame to the pool wall can be changed, as can the number of double-headed screws 9 used to affix the skimmer guard to the frame. These and other modifications, which will be apparent to the reader skilled in the art, should be considered within the spirit and scope of the following claims.

What is claimed is:

1. In a pool having an opening, the opening providing fluid communication with a skimmer for treatment of liquid drawn from the pool, the opening being bounded by a frame attached to a wall of the pool, the improvement wherein the frame is attached to the pool wall by a screw having inner and outer heads, the inner and outer heads being spaced apart to define a gap, the improvement including a skimmer guard, the skimmer guard including at least one keyhole sized to allow the screw to pass through the keyhole, at least a portion of the skimmer guard being inserted by friction within the gap.

2. The improvement of claim 1, wherein the skimmer guard has a plurality of perforations.

3. The improvement of claim 2, wherein the perforations remain unblocked when the skimmer guard is attached to the frame, wherein the perforations permit liquid to enter the skimmer while preventing entry of debris from the pool.

4. The improvement of claim 1, wherein the skimmer guard has no perforations except for said keyhole.

5. The improvement of claim 1, wherein the inner heads have a conical shape.

6. The improvement of claim 1, wherein the inner heads are substantially flush with a surface of the frame.

7. Apparatus for protecting a skimmer opening which is in fluid communication with a skimmer used with a pool, comprising:

a) a plurality of double-headed screws affixed to the skimmer opening, each double-headed screw having an outer head and an inner head, the outer and inner heads being spaced apart to form a gap, and b) a skimmer guard, the skimmer guard having a plurality of keyholes corresponding to said screws, the keyholes being sized to allow said screws to pass through the keyholes, the skimmer guard being held within said gap.

8. The apparatus of claim 7, wherein the inner head has a conical shape.

9. The apparatus of claim 7, wherein the skimmer guard has a plurality of perforations.

10. The apparatus of claim 7, wherein the skimmer guard has no perforations except for said keyholes.

11. The apparatus of claim 7, further comprising a frame attached to the skimmer opening, the frame having a surface, and wherein the inner heads are substantially flush with said surface of the frame.

12. A method of protecting a skimmer of a pool from intrusion of debris, the pool including a wall having an opening for allowing liquid from the pool to enter the skimmer, the method comprising frictionally engaging a skimmer guard, the skimmer guard including a body having a plurality of holes and at least one keyhole, with the opening, wherein the skimmer guard at least partially covers the opening, the skimmer guard being engaged without the use of any separate fastening device, wherein the frictionally engaging step comprises wedging the skimmer guard into a gap between heads of a double-headed screw which is affixed to a skimmer opening, the wedging step including passing the screw through said keyhole.

13. The method of claim 12, further comprising removing the skimmer guard and replacing the skimmer guard with an alternate skimmer guard which has no holes except for a keyhole.

14. The method of claim 13, wherein the removing step comprises sliding the skimmer guard such that the keyhole is in registration with the double-headed screw, and pulling the skimmer guard so as to release the skimmer guard from the screw.

15. The method of claim 12, wherein the wedging step comprises fitting said keyhole, formed in the skimmer guard, over an outer head of said double-headed screw, and sliding the skimmer guard into said gap so as to engage the screw by friction.

* * * * *